US011330852B2

(12) United States Patent
Luo

(10) Patent No.: US 11,330,852 B2
(45) Date of Patent: May 17, 2022

(54) AIR-CONDITIONING GARMENT WITH PORTABLE MINIATURE AIR CONDITIONER

(71) Applicant: GUANGZHOU DESHAN CNC TECHNOLOGY CO., LTD., Guangdong (CN)

(72) Inventor: Yingxue Luo, Guangzhou (CN)

(73) Assignee: GUANGZHOU DESHAN CNC TECHNOLOGY CO., LTD., Guangzhou (CN)

( * ) Notice: Subject to any disclaimer, the term of this patent is extended or adjusted under 35 U.S.C. 154(b) by 248 days.

(21) Appl. No.: 16/610,633

(22) PCT Filed: Dec. 12, 2017

(86) PCT No.: PCT/CN2017/115687
§ 371 (c)(1),
(2) Date: Nov. 4, 2019

(87) PCT Pub. No.: WO2018/201725
PCT Pub. Date: Nov. 8, 2018

(65) Prior Publication Data

US 2020/0054080 A1 Feb. 20, 2020

(30) Foreign Application Priority Data

May 5, 2017 (CN) ..... 20171031907.7

(51) Int. Cl.
*A41D 13/005* (2006.01)
*F24F 5/00* (2006.01)
(Continued)

(52) U.S. Cl.
CPC ..... *A41D 13/005* (2013.01); *F24F 5/001* (2013.01); *A41D 13/0053* (2013.01);
(Continued)

(58) Field of Classification Search
CPC ..... F25D 2400/26; A41D 13/0053; A41D 13/005; A41D 2400/12; F24F 5/001
See application file for complete search history.

(56) References Cited

U.S. PATENT DOCUMENTS 2,540,547 A * 2/1951 Rodert ..... B64D 10/00 165/47
4,513,452 A * 4/1985 Rankin, Sr. ..... A41D 13/0053 2/8.1

(Continued)

FOREIGN PATENT DOCUMENTS

CN 104366746 A * 2/2015
CN 104366746 A 2/2015

(Continued)

OTHER PUBLICATIONS

International Search Report of PCT/CN2017/115687 dated Mar. 5, 2018.

*Primary Examiner* — Lionel Nouketcha
(74) *Attorney, Agent, or Firm* — Sughrue Mion, PLLC

(57) ABSTRACT

An air-conditioning garment includes a garment, a miniature air conditioner, and a convenient strap for carrying the miniature air conditioner on the garment. The garment includes an outer layer and an inner layer sealed together to form an air channel, at least two air holes are arranged across the outer layer of the garment, the garment and the miniature air conditioner are connected by an air inlet tube and an air outlet tube, and one end of the air inlet tube and one end of the air outlet tube are respectively connected to at least two of the air holes, so as to be connected to the air channel of the garment.

7 Claims, 6 Drawing Sheets

(51) Int. Cl.
*F24F 13/20* (2006.01)
*F24F 13/30* (2006.01)

(52) U.S. Cl.
CPC ..... *A41D 2400/12* (2013.01); *F24F 13/20* (2013.01); *F24F 13/30* (2013.01); *F25D 2400/26* (2013.01)

(56) References Cited

U.S. PATENT DOCUMENTS 5,255,390 A * 10/1993 Gross ..... A41D 13/0025 2/458
6,823,678 B1 11/2004 Li
8,281,609 B1 * 10/2012 Rothschild ..... A41D 13/0053 62/259.3

FOREIGN PATENT DOCUMENTS

CN 204377971 U 6/2015
CN 104839906 A 8/2015
CN 204830194 U * 12/2015
CN 204830194 U 12/2015
CN 205456206 U 8/2016
CN 107080308 A 8/2017
CN 206822022 U 1/2018

* cited by examiner

AIR-CONDITIONING GARMENT WITH PORTABLE MINIATURE AIR CONDITIONER

CROSS REFERENCE TO RELATED APPLICATIONS

This application is a National Stage of International Application No. PCT/CN2017/115687 filed Dec. 12, 2017, claiming priority based on Chinese Patent Application No. 201710313907.7 filed May 5, 2017.

FIELD

The present disclosure relates to the field of air-conditioning garments, and more particularly, to an air-conditioning garment with a portable miniature air conditioner.

BACKGROUND

At present, the refrigeration is mainly realized by the following three ways in the refrigerating garment industry.

I. Air-cooling garment provided with a fan, wherein: a fan fixed on the garment is mainly used to blow air into the garment, and then an air outlet is used to exhaust air to dissipate heat. For this type of refrigerating garment the refrigeration is greatly affected by the ambient temperature, and the refrigerating effect is not obvious if the ambient temperature is high.

II. Water-cooling garment, wherein: cool water is pumped into the special garment though a water pipe by a water pump unit to take away the heat emitted by the human body, then the water is recovered to the water pump unit by a recovery pipeline, and the cycle is repeated in this way. This type of refrigerating garment is large in weight and volume, because not only water needs to be filled, but also the leakage of water needs to be concerned during use.

III. Ice-bag refrigerating garment, wherein: a pocket is designed in the special garment for filling ice cubes to be put into the pocket to cool the human body. The refrigerating duration of this type of refrigerating garment is short, the refrigeration is uneven, and the refrigerating source needs to be supplied frequently.

SUMMARY

In order to solve the problems above, the present disclosure provides an air-conditioning garment with a portable miniature air conditioner, which has a simple structure.

The technical solutions used in the present disclosure to solve the technical problems thereof are as follows.

An air-conditioning garment with a portable miniature air conditioner includes a garment, a miniature air conditioner, and a convenient strap for carrying the miniature air conditioner on the garment, wherein the garment includes an outer layer and an inner layer sealed together to form an air channel, at least two air holes are arranged across the outer layer of the garment, the garment and the miniature air conditioner are connected by an air inlet tube and an air outlet tube, and one end of the air inlet tube and one end of the air outlet tube are respectively connected to at least two of the air holes, so as to be connected to the air channel of the garment.

As further improvement to the technical solution above, the outer layer is made of airtight waterproof fabric, and the inner layer is made of air-permeable fabric.

As further improvement to the technical solution above, the convenient strap is provided with a placing bag for placing the miniature air conditioner, a middle part of the air inlet tube is fixedly arranged on the convenient strap, and the convenient strap is further provided with an air hole cover for covering each air hole.

As further improvement to the technical solution above, the miniature air conditioner includes an outer hood, and a condenser, a compressor and an evaporator sequentially arranged in the outer hood from top to bottom, a sealing baffle separating the condenser, the compressor and the evaporator is arranged in the outer hood, and the miniature air conditioner further includes a liquid reservoir integrally arranged at a bottom of the compressor.

As further improvement to the technical solution above, the outer hood is provided with a hot air inlet and a hot air outlet for inputting and outputting hot air, as well as a cool air inlet and a cool air outlet for inputting and outputting cool air, and the hot air outlet and the cool air outlet are respectively provided with a first exhaust fan and a second exhaust fan.

As further improvement to the technical solution above, the air inlet tube and the air outlet tube are respectively connected to the cool air outlet and the cool air inlet.

As further improvement to the technical solution above, the air inlet tube and the air outlet tube are respectively connected to the hot air outlet and the hot air inlet.

As further improvement to the technical solution above, the outer hood includes an outer hood cylinder, as well as a top cover and a bottom cover arranged at a top and a bottom of the outer hood cylinder, and the sealing baffle is fixedly arranged on an inner wall of the outer hood cylinder.

As further improvement to the technical solution above, the outer hood cylinder is formed by butting a plurality of arc-shaped outer hood flaps, the sealing baffle includes a plurality of unit baffles vertically fixed on each outer hood flap respectively, and the sealing baffle is formed by butting the unit baffles.

As further improvement to the technical solution above, the condenser and the evaporator are both provided with a heat exchange plate, and each heat exchange plate is made of a micro-channel aluminum flat tube.

The present disclosure has the beneficial effects that the air-conditioning garment with a portable miniature air conditioner is configured so that a user can carry the miniature air conditioner while wearing the garment and the convenient strap. The miniature air conditioner is connected to the air channel of the garment by the air inlet tube and the air outlet tube, so that cool air inside the miniature air conditioner can be exchanged with air inside the garment and circulated to reduce body temperature. The at least two air holes are configured so as to allow easy connection of the air inlet tube and the air outlet tube to different locations according to different usage habits. The air-conditioning garment has a simple structure and is easy to use.

BRIEF DESCRIPTION OF THE DRAWINGS

The present disclosure is further described hereinafter with reference the drawings.

DETAILED DESCRIPTION

Figure 1:
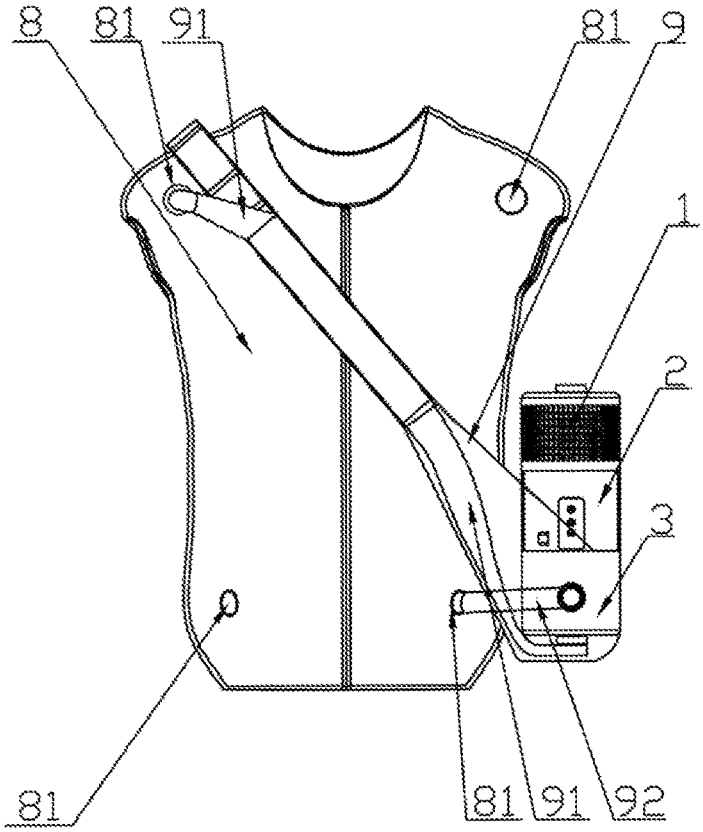
FIG. 1 is a front view of an overall structure of an air-conditioning garment with a portable miniature air conditioner.
Figure 2:
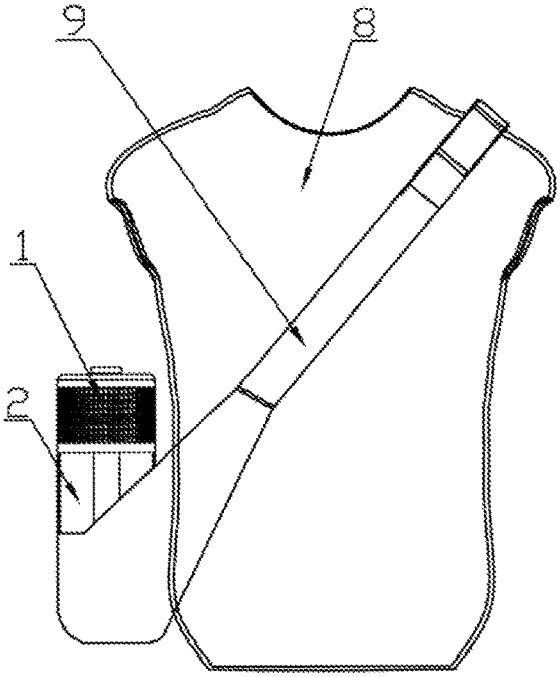
FIG. 2 is a rear view of the overall structure of the air-conditioning garment with a portable miniature air conditioner.

With reference to FIG. 1 to FIG. 8, the present disclosure is an air-conditioning garment with a portable miniature air conditioner, which includes a garment 8, a miniature air conditioner, and a convenient strap 9 for carrying the miniature air conditioner on the garment 8. The garment 8 includes an outer layer and an inner layer sealed together to form an air channel. At least two air holes 81 are arranged across the outer layer of the garment 8. The garment 8 and the miniature air conditioner are connected by an air inlet tube 91 and an air outlet tube 92, wherein one end of the air inlet tube 91 and one end of the air outlet tube 92 are respectively connected to two of the air holes 81, so as to be connected to the air channel of the garment 8.

The garment 8 is configured so that a user can carry the miniature air conditioner while wearing the garment 8 and the convenient strap 9. The miniature air conditioner is connected to the air channel of the garment 8 by the air inlet tube 91 and the air outlet tube 92, so that cool air inside the miniature air conditioner can be exchanged with air inside the garment 8 and circulated to reduce body temperature. The at least two air holes 81 are configured so as to allow easy connection of the air inlet tube 91 and the air outlet tube 92 to different locations according to different usage habits. The air-conditioning garment is simple in structure and easy in use.

In a preferred embodiment, the outer layer is made of airtight waterproof fabric, and the inner layer is made of air-permeable fabric.

The purpose of the arrangement is to prevent external air from entering the garment 8, and meanwhile, cool air or hot air in the garment 8 can be gradually dispersed into the human body, thus achieving the technical effect of cooling or keeping warm.

In a preferred embodiment, the convenient strap 9 is provided with a placing bag for containing the miniature air conditioner. A middle part of the air inlet tube 91 is fixedly arranged on the convenient strap 9. The convenient strap 9 is further provided with an air hole cover for covering each air hole 81.

Further, the garment 8 is a waistcoat vest. The convenient strap 9, the air inlet tube 91 and the air outlet tube 92 are designed into an integrated part.

In a preferred embodiment, the miniature air conditioner includes an outer hood 6, and a condenser 1, a compressor 2 and an evaporator 3 sequentially arranged in the outer hood 6 from top to bottom. A sealing baffle 613 separating the condenser 1, the compressor 2 and the evaporator 3 is arranged in the outer hood 6. The miniature air conditioner further includes a liquid reservoir integrally arranged at a bottom of the compressor 2.

As compared with the traditional externally-arranged liquid reservoir, the embodiment can obviously reduce an occupied space of the miniature air conditioner and reduce a weight of the miniature air conditioner.

In a preferred embodiment, the outer hood 6 is provided with a hot air inlet 611 and a hot air outlet 621 for inputting and outputting hot air, as well as a cool air inlet 612 and a cool air outlet 631 for inputting and outputting cool air. The hot air outlet 621 and the cool air outlet 631 are respectively provided with a first exhaust fan 11 and a second exhaust fan 31.

In a preferred embodiment, the air inlet tube 91 and the air outlet tube 92 are respectively connected to the cool air outlet 631 and the cool air inlet 612.

Figure 3:
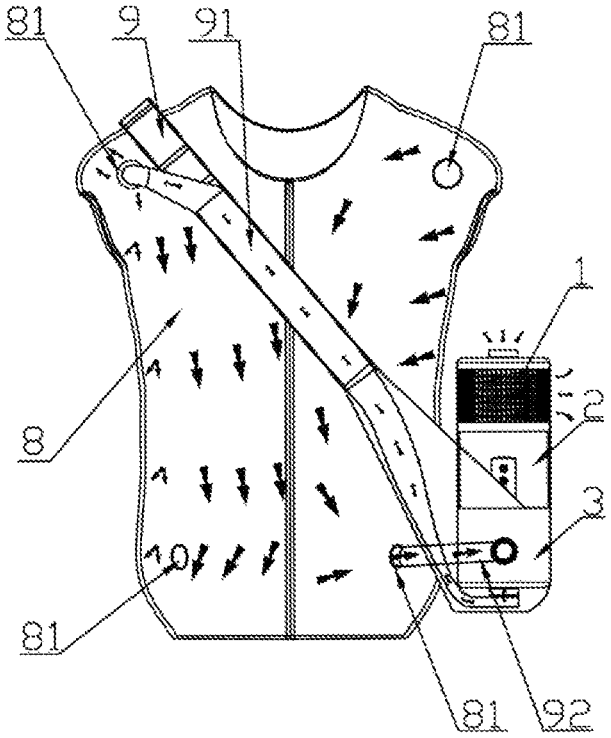
FIG. 3 is a diagram illustrating a refrigerating process of the air-conditioning garment with a portable miniature air conditioner.

With reference to FIG. 3, the embodiment is a refrigerating embodiment, in which cool air is supplied to the human body so as to reduce a body temperature.

In a preferred embodiment, the air inlet tube 91 and the air outlet tube 92 are respectively connected to the hot air outlet 621 and the hot air inlet 611.

Figure 4:
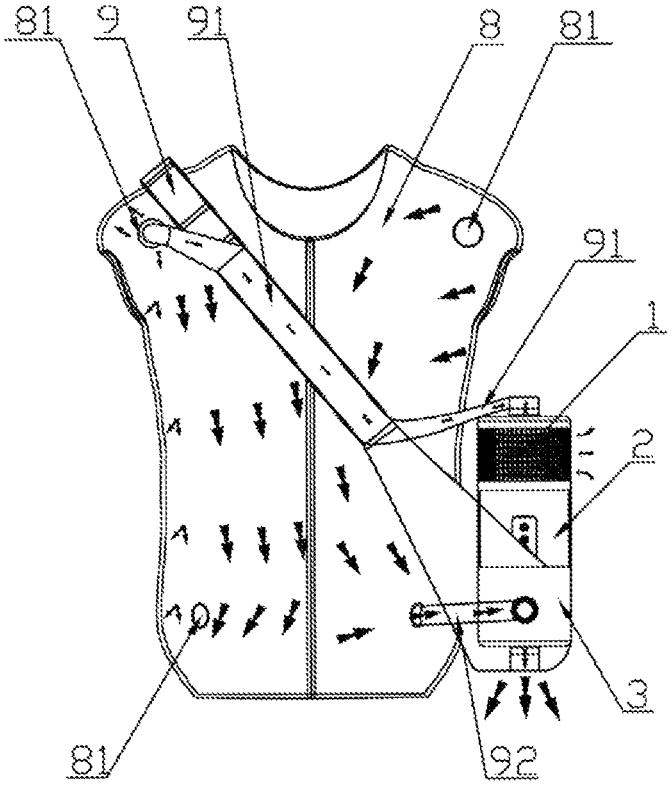
FIG. 4 is a diagram illustrating a heating process of the air-conditioning garment with a portable miniature air conditioner.
Figure 5:
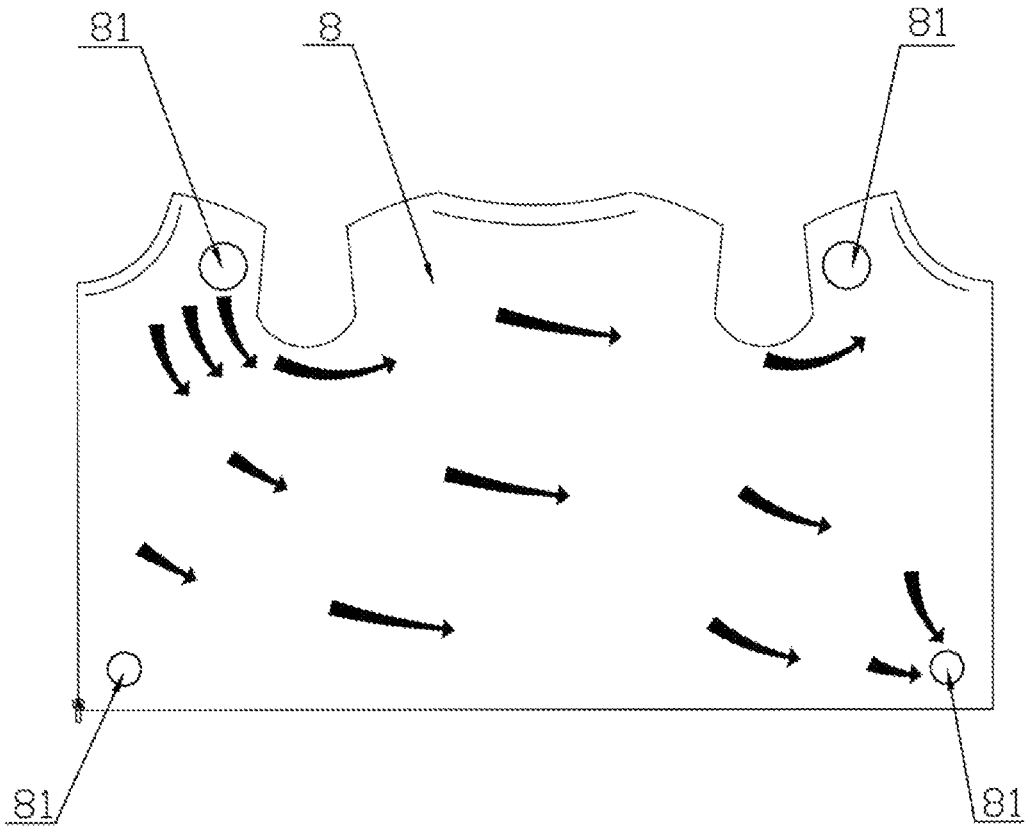
FIG. 5 is a diagram of an overall structure of a garment of the air-conditioning garment with a portable miniature air conditioner.
Figure 6:
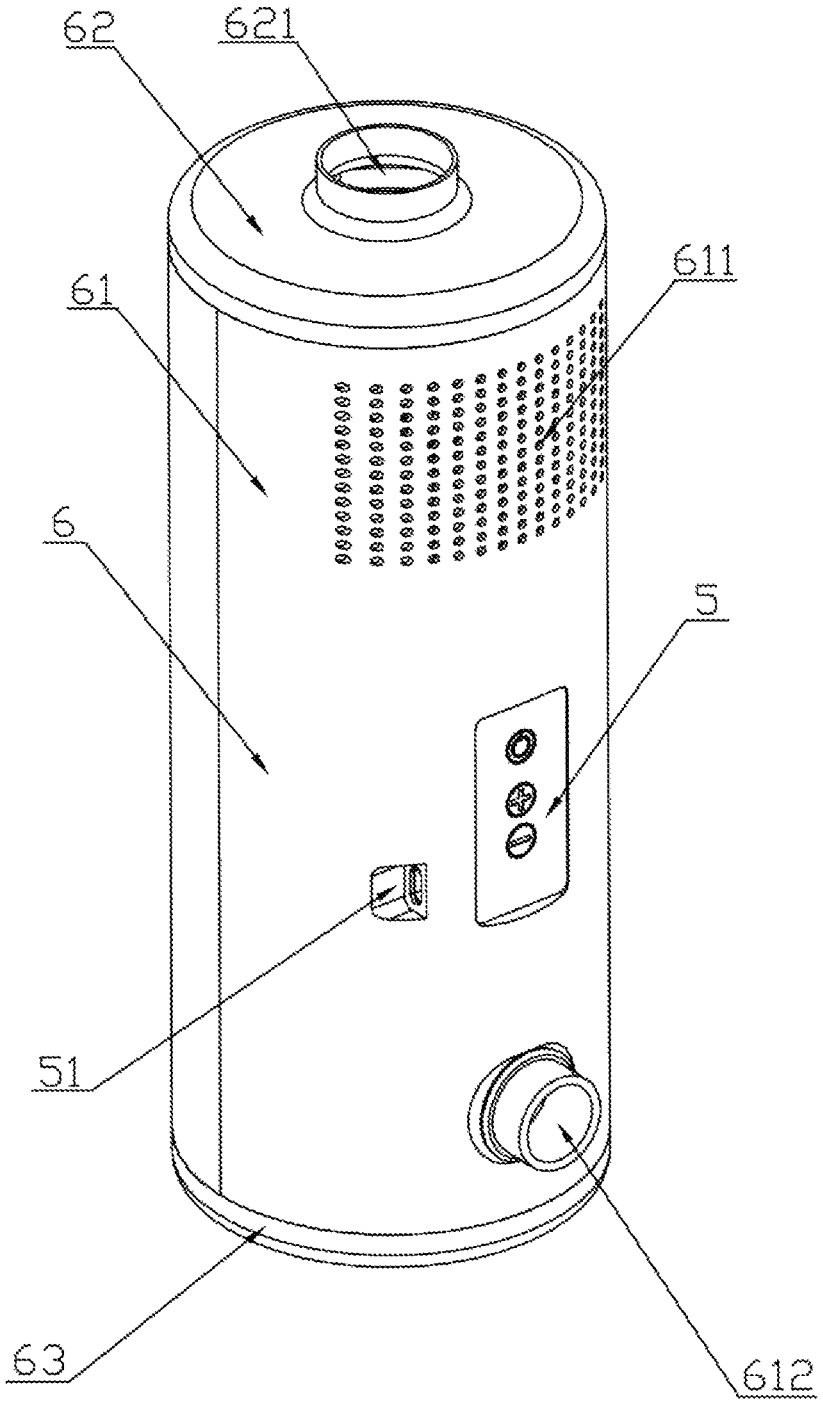
FIG. 6 is a diagram of an overall structure of a miniature air conditioner of the air-conditioning garment with a portable miniature air conditioner.
Figure 7:
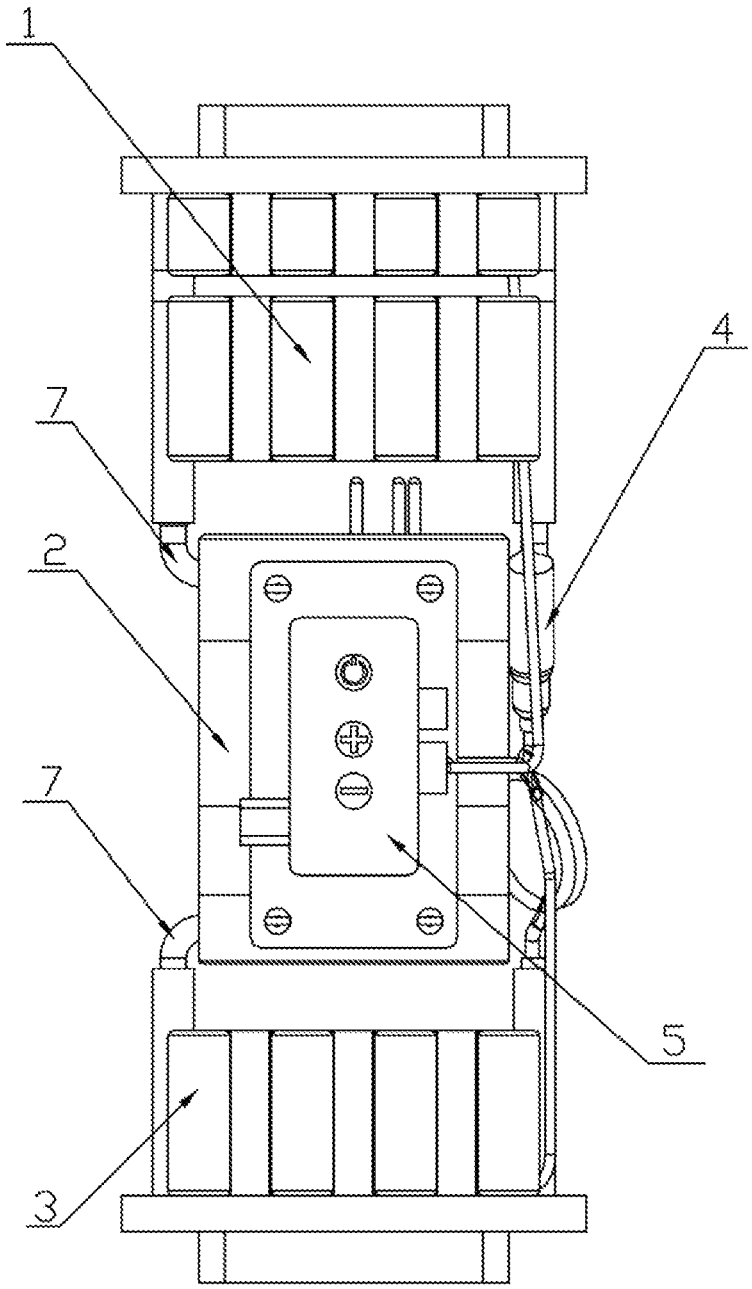
FIG. 7 is a diagram of an internal structure of the miniature air conditioner of the air-conditioning garment with a portable miniature air conditioner.
Figure 8:
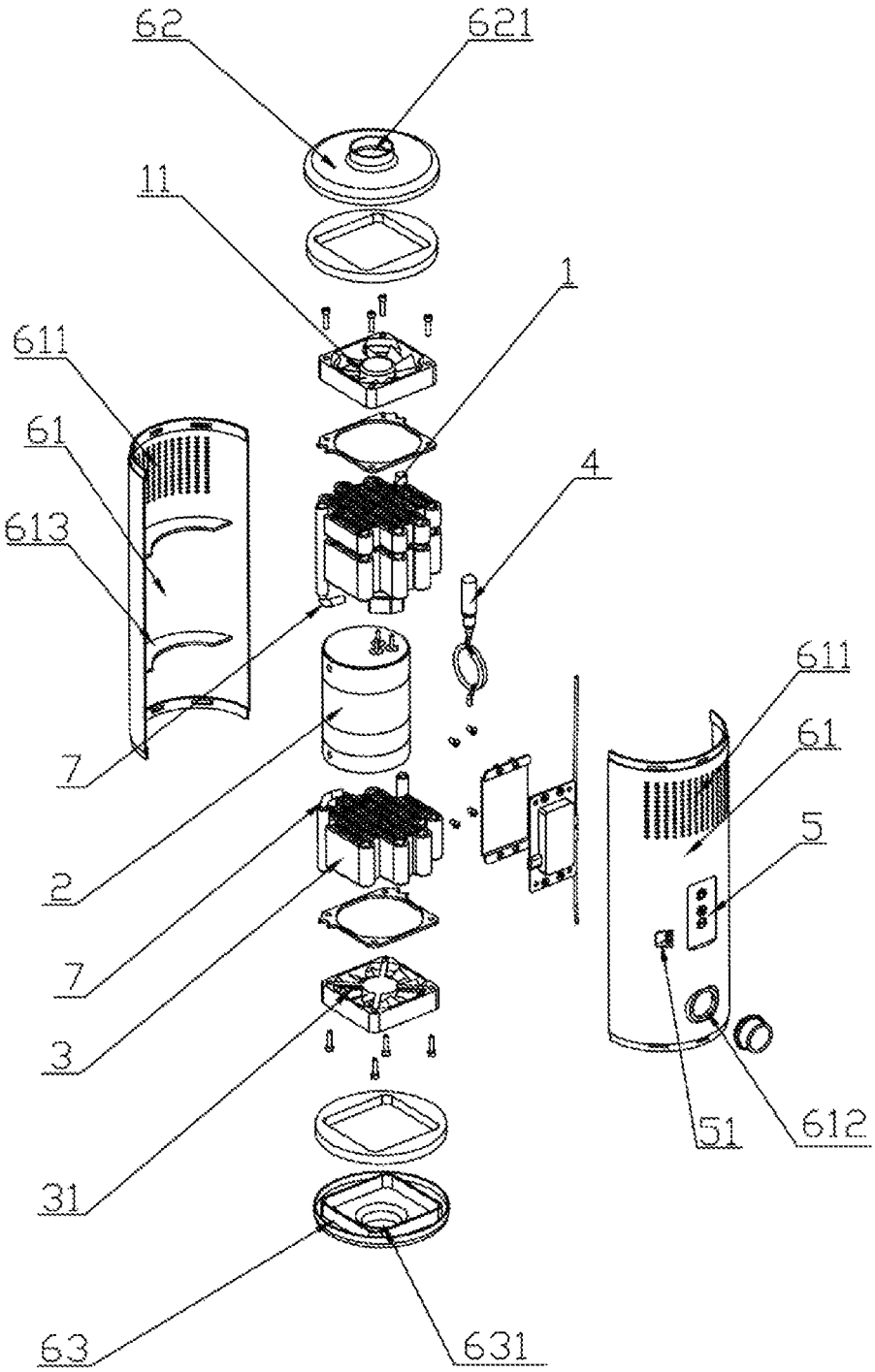
FIG. 8 is an exploded diagram of the overall structure of the miniature air conditioner of the air-conditioning garment with a portable miniature air conditioner.

With reference to FIG. 4, the process is similar to a reverse process of refrigeration, and the embodiment is a heating embodiment, in which hot air is supplied to the human body so as to keep warm.

In a preferred embodiment, the outer hood 6 includes an outer hood cylinder, as well as a top cover 62 and a bottom cover 63 arranged at a top and a bottom of the outer hood cylinder. The sealing baffle 613 is fixedly arranged on an inner wall of the outer hood cylinder.

In a preferred embodiment, the outer hood cylinder is formed by butting a plurality of arc-shaped outer hood flaps 61. The sealing baffle 613 includes a plurality of unit baffles vertically fixed on each outer hood flap 61 respectively. The sealing baffle 613 is formed by butting the unit baffles.

In a preferred embodiment, the condenser 1 and the evaporator 3 are both provided with a heat exchange plate that is made of a micro-channel aluminum flat tube.

Such arrangement of each heat exchange plate made of the micro-channel aluminum flat tube can promote heat exchange between the condenser 1 and the evaporator 3 and improve a heat exchange efficiency.

In a preferred embodiment, the hot air outlet 621 is arranged on the top cover 62, the hot air inlet 611 is arranged on an upper side of the outer hood cylinder, and the hot air inlet 611 includes a plurality of air inlet holes arranged in the outer hood cylinder.

In a preferred embodiment, the cool air inlet 612 is arranged on a lower side of the outer hood cylinder, and the cool air outlet 631 is arranged on the bottom cover 63.

In a preferred embodiment, a capillary tube 4 is also arranged to transfer a refrigerant between the condenser 1 and the evaporator 3.

In a preferred embodiment, the outer hood 6 is provided with a working condition adjusting button 5 and a power interface 51 connected to the working condition adjusting button 5. An access voltage of the power interface 51 has various specifications.

The power interface 51 provided by the first batch of products of the air-conditioning garment with a portable miniature air conditioner has two access voltages 12 V and 24 V, and a solar power supply mode can be set in the later period according to needs, thus meeting the design concept of environmental protection.

In a preferred embodiment, the compressor 2 is integrally welded by all-steel machined fittings.

In a preferred embodiment, the liquid reservoir is arranged between the compressor 2 and the evaporator 3, and further, the liquid reservoir is internally welded at a bottom of the compressor 2.

In a preferred embodiment, a refrigerant pipeline 7 for conveying a refrigerant is also arranged, an inlet and an outlet of the compressor 2 are respectively connected to an outlet of the evaporator 3 and an inlet of the condenser 1 through the refrigerant pipeline 7, and an outlet of the condenser 1 is connected to an inlet of the evaporator 3.

In a preferred embodiment, the inlet of the condenser 1 and the outlet of the compressor 2 are welded into a whole through the refrigerant pipeline 7, and the outlet of the evaporator 3 and the inlet of the compressor 2 are welded into a whole through the refrigerant pipeline 7.

The condenser 1, the compressor 2, the evaporator 3 and the capillary tube 4 are all integrally arranged in the cylindrical outer hood 6. The integrated miniature air conditioner design concept not only greatly reduces an occupied space of the air conditioner, but also greatly reduces a weight of the air conditioner, so that the air conditioner is convenient to carry and is applied to the refrigerating garment.

In a preferred embodiment, the working condition adjusting button 5 and the power interface 51 are connected to lines of the condenser 1, the compressor 2 and the evaporator 3.

In a preferred embodiment, four air holes 81 are respectively arranged at an upper left position, a lower left position, an upper right position and a lower right position of the garment 8.

For the miniature air conditioner, the condenser 1, the compressor 2 and the evaporator 3 separated from each other by the sealing baffle 613 are arranged in the outer hood 6, so that the structure is compact, and the occupied space of the miniature air conditioner is saved. The liquid reservoir is integrally arranged at the bottom of the compressor 2, so that the occupied space of the miniature air conditioner is further reduced. As compared with the traditional external arrangement of the liquid reservoir, the arrangement enables the miniature air conditioner to have a smaller volume and to be convenient to carry. After the power interface 51 is connected to a power supply, a low-pressure gaseous refrigerant in the compressor 2 is processed into a high-pressure gaseous refrigerant by the compressor 2, and the high-pressure gaseous refrigerant enters the condenser 1 through the refrigerant pipeline 7. After the power supply is connected, the first exhaust fan 11 in the condenser 1 is started, at the moment, air in a condensing chamber is exhausted through the hot air outlet 621, a negative pressure is formed in the condensing chamber, external air enters the condensing chamber through the hot air inlet 611, and meanwhile, the high-pressure gaseous refrigerant in the condenser 1 releases heat to transfer the heat to the air entering the condensing chamber, the high-pressure gaseous refrigerant becomes a high-pressure liquid refrigerant, and the high-pressure liquid refrigerant begins to depressurize and expand through the capillary tube 4 and then enters the evaporator 3. Also due to the connection to the power supply, the second exhaust fan 31 in the evaporator 3 outputs cool air in the evaporator 3 to a pipeline connected to cool air through the cool air outlet 631, at the moment, a negative pressure is formed in the evaporator 3, the cool air that has cooled the human body or the environment externally flows back into the evaporator 3 through the cool air inlet 612. Since the high-pressure liquid refrigerant has absorbed a certain amount of external heat from the cool air flowing back into the evaporator 3, at the moment, a low-pressure liquid refrigerant in the evaporator 3 absorbs the heat to form the low-pressure gaseous refrigerant, the cool air circulating back into the evaporator 3 forms new cool air after the heat is absorbed, which is exhausted from the evaporator 3 again through the second exhaust fan 31 to form circulating cool air, thus continuously providing cool air, and the low-pressure gaseous refrigerant in the condenser 3 enters the compressor 2 for the next cycle.

Due to the characteristics of small volume, light weight, convenience to carry and multi-purpose use of cooling and heating, the air-conditioning garment with a portable miniature air conditioner meets a refrigerating requirement in a high-temperature environment or a heating requirement in a low-temperature environment, and creates a comfortable working environment for workers in corresponding working environments.

Certainly, the present disclosure is not limited to the embodiments above, those skilled in the art may make equal deformations or replacements without deviating from the principle of the present disclosure, and these equal deformations or replacements all fall within the scope limited by the claims of the present application.

The invention claimed is:

1. An air-conditioning garment, comprising a garment having an outer layer and an inner layer sealed together to form an air channel, a miniature air conditioner comprising an outer hood provided with a hot air inlet and a hot air outlet for inputting and outputting hot air, as well as a cool air inlet and a cool air outlet for inputting and outputting cool air, a condenser, a compressor, an evaporator, a sealing baffle arranged in the outer hood, and a liquid reservoir integrally arranged at a bottom of the compressor, and a convenient strap for carrying the miniature air conditioner on the garment, wherein:

at least two air holes are arranged across the outer layer of the garment;

the garment and the miniature air conditioner are connected by an air inlet tube and an air outlet tube; and one end of the air inlet tube is connected to a first air hole of the at least two air holes, and one end of the air outlet tube is connected to a second air hole of the at least two air holes, so as to be connected to the air channel of the garment; and wherein the condenser, the compressor and the evaporator sequentially are arranged in the outer hood from top to bottom, and separated by the sealing baffle; and the hot air outlet and the cool air outlet are respectively provided with a first exhaust fan and a second exhaust fan.

2. The air-conditioning garment as claimed in claim 1, wherein the outer layer is made of airtight waterproof fabric, and the inner layer is made of air-permeable fabric.

3. The air-conditioning garment as claimed in claim 1, wherein the air inlet tube and the air outlet tube are respectively connected to the cool air outlet and the cool air inlet.

4. The air-conditioning garment as claimed in claim 1, wherein the air inlet tube and the air outlet tube are respectively connected to the hot air outlet and the hot air inlet.

5. The air-conditioning garment as claimed in claim 1, wherein: the outer hood comprises an outer hood cylinder, as well as a top cover and a bottom cover arranged at a top and a bottom of the outer hood cylinder; and the sealing baffle is fixedly arranged on an inner wall of the outer hood cylinder.

6. The air-conditioning garment as claimed in claim 5, wherein: the outer hood cylinder is formed by butting a plurality of arc-shaped outer hood flaps; the sealing baffle comprises a plurality of unit baffles vertically fixed on each outer hood flap respectively; and the sealing baffle is formed by butting the unit baffles.

7. The air-conditioning garment as claimed in claim 1, wherein the condenser and the evaporator are both provided with a heat exchange plate; and each heat exchange plate is made of a micro-channel aluminum flat tube.

* * * * *